United States Patent [19]

Beals

[11] Patent Number: 4,779,508

[45] Date of Patent: Oct. 25, 1988

[54] DRUMHEAD CONSTRUCTION

[75] Inventor: Robert C. Beals, Dodge City, Kans.

[73] Assignee: Evans Products, Inc., Dodge City, Kans.

[21] Appl. No.: 61,589

[22] Filed: Jun. 15, 1987

[51] Int. Cl.[4] ..... G10D 13/02

[52] U.S. Cl. ..... 84/414; 84/413

[58] Field of Search ..... 84/411–417

[56] References Cited

U.S. PATENT DOCUMENTS

| | | | |
|---|---|---|---|
| 2,979,981 | 4/1961 | Ludwig | 84/411 R |
| 3,250,169 | 5/1966 | Stone et al. | 84/411 R |
| 3,418,877 | 12/1968 | Ito | 84/414 |

*Primary Examiner*—Lawrence R. Franklin

*Attorney, Agent, or Firm*—Kokjer, Kircher, Bradley, Wharton, Bowman & Johnson

[57] ABSTRACT

A drumhead which includes a polyester film having a marginal flange bonded in a channel presented by metal hoop. Fiber reinforced polyester resin is poured into the channel and embeds the edge of the drumhead flange upon hardening. An inturned lip on the outside wall of the channel provides an interference fit with the resin to securely hold it in the channel. The upper edge of the inside wall of the channel is beveled at the same angle as the drumhead flange to provide a flat surface for the drumhead to seal against. A special spring clip is applied within the channel to secure the butt joint between opposite ends of the hoop.

18 Claims, 1 Drawing Sheet

DRUMHEAD CONSTRUCTION

BACKGROUND OF THE INVENTION

This invention relates in general to drums and more particularly to an improved drum head construction.

Modern drum heads are typically constructed of polyester films which are secured at their edges in various ways. As disclosed in U.S. Pat. No. 2,934,989 to Belli et al., the edge of the film may be inserted into a channel shaped metal hoop which is then filled with a resinous bonding material that bonds the head to the channel. Pins and various other mechanical fasteners have also been used either alone or together with a bonding substance.

Although this type of construction has long been used, it has not been wholly free of problems. A major difficulty that can lead to early failure of the drumhead results from the susceptibility of the resin to release from the hoop due to the sometimes considerable forces that are applied to the drumhead. Because of the simple channel shaped construction of the hoop, there is nothing but the bonding force between the resin and the hoop to hold the resin in place, and if the bonding force fails, the resin can simply slip out of the channel and release the margin of the drumhead. Another problem of the simple U-shaped channel is that it provides only a relatively small area for the counter hoop of the drum to bear against. The resin can also easily run out of the channel before it has hardened, thus creating unattractive "blobs" which can detract significantly from the appearance of the drum.

Another problem that can lead to early failure of the drumhead is created by the presentation of sharp edges on the retaining hoop which can contact the polyester film and cut or otherwise damage it. The joint between the two ends of the hoop has been a particularly serious source of problems. Typically, this joint creates a weak point of the drumhead which is reinforced by crimping a reinforcing strip onto the butting ends of the inside wall of the channel. Such crimped metal strips often fail to add enough strength to the joint to enable it to withstand the forces to which it is subjected in normal use. Moreover, a joint constructed in this manner can easily become misaligned and is unsightly in any event.

SUMMARY OF THE INVENTION

The present invention provides a drumhead which is constructed in an improved manner to overcome the foregoing problems. In accordance with the invention, a fluted flange on the periphery of the drumhead is received in a specially shaped metal hoop and is bonded to the hoop by a fiber reinforced resin. The hoop is roll formed generally in the shape of a channel but is provided on its inside wall with a beveled edge and on its outside wall with an inturned lip. The lip stiffens the hoop and creates an interference fit with the polyester resin in order to mechanically lock the resin in the channel. The beveled edge on the inside channel wall has the same angle as the angle of the drumhead flange, and the flange is thus able to seat flatly against the beveled surface without contacting any sharp edges or other parts that cause undue wear or apply cutting forces. At the same time, the large surfaces of contact between the drumhead and the beveled surface prevent the resin from inadvertently slopping out of the channel.

A particularly important feature of the invention is the provision of a uniquely constructed spring clip which secures the butt joint formed between the two ends of the metal hoop. The clip is U-shaped in section and fits closely within the channel with its opposite sides springing apart to hold the inside and outside walls of the channel in alignment and the butted ends of the hoop together. One side of the spring clip has an edge which lodges against the underside of the lip on the outer channel wall. The other side of the clip is provided with sharp teeth which bite into the inner channel wall to help secure the joint.

DESCRIPTION OF THE DRAWING

In the accompanying drawing which forms a part of the specification and is to be read in conjunction therewith and in which like reference numerals are used to indicate like parts in the various views.

DETAILED DESCRIPTION OF THE INVENTION

Figure 1:
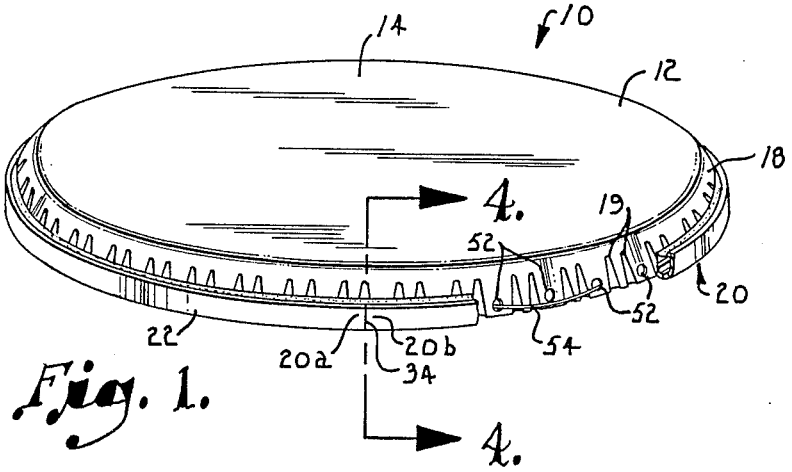
FIG. 1 is a perspective view of a drumhead constructed according to a preferred embodiment of the present invention, with a portion broken away for purposes of illustration.
Figure 2:
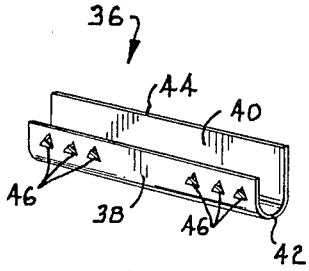
FIG. 2 is a perspective view of the U-shaped spring clip which secures the joint between the ends of the metal hoop included in the drumhead.

Referring now to the drawing in more detail, numeral 10 generally designates a drumhead constructed in accordance with the present invention. The drumhead 10 includes a polyester film 12 which forms the surface that is actually struck with the drum sticks. The polyester film 12 includes a generally circular central portion 14 which is stretched across the cylindrical drum body 16 (See FIG. 5). A peripheral flange 18 extends from and is integral with the circular portion 14. The flange 18 extends downwardly and outwardly from the edge of portion 14 at an angle of approximately 45° from the plane of section 14, although various angles can be used. The flange 18 is provided with equally spaced flutes 19 which accommodate the change of direction of the plastic film where the flange is bent away from the central portion 14. The evenly spaced flutes enhance the appearance of the drumhead and provide repeatability in the manufacture of the drumhead as well as allowing the drumhead to be evenly tuned. The flange 18 terminates in a free edge which is substantially circular.

The flange 18 of the drumhead is secured to a metal hoop which is generally designated by numeral 20. The hoop 20 is roll formed in the shape of a generally U-shaped channel 22 having an inside wall 24 and a outside wall 26 which are substantially parallel to one another. The bottom of channel 22 is formed by a curved bight portion 28 which connects the inside and outside walls 24 and 26. The upper edge of the inside wall 24 is beveled to provide a flat beveled surface 30 against which flange 18 flatly seats. A lip 32 is turned inwardly from the upper edge of the outside wall 26 and acts to stiffen the hoop 20. Lip 32 is perpendicular to wall 26. The channel 22 is open at its top, and the flange 18 extends into the channel through its open top.

The metal hoop 20 is preferably constructed of aluminum, although other materials may be used. With particular reference to FIG. 1, a butt joint 34 is formed in hoop 20 at the location where the opposite end portions 20*a* and 20*b* are butted together. The joint 34 is secured by a generally U-shaped spring clip which is generally identified by numeral 36 and may be constructed of spring steel or another suitable substance. The spring clip 36 fits inside of channel 22 at the joint 34 and spans the joint such that it engages the opposite ends 20*a* and 20*b* of hoop 20. The spring clip 36 includes a pair of opposite sides 38 and 40 which are connected at the bottom by a curved bight portion 42 of the spring clip. When the clip is inserted into channel 22, the outer side 40 lies generally flatly along the inside surface of the outside wall 26 of the channel. Side 40 terminates in an upper edge 44 which is lodged against the underside of lip 32. The inner side 38 of the clip is provided with a plurality of teeth 46 which are punched outwardly from side 38 and which terminate in sharp tips that bite into the inside surface of the inner sidewall 24 of channel 22.

When clip 36 is inserted in channel 22, the sides 38 and 40 are deformed toward one another and resist such deformation by spring action which causes the opposite sides 38 and 40 to spread apart and thus apply a spring force against the sidewalls 24 and 26 of channel 22. At the same time, the teeth 46 dig into wall 24 on opposite sides of the joint 34, while edge 44 is lodged against lip 32 on opposite sides of the joint. The spring force provided by clip 36, together with the edge 44 and teeth 46, holds the sidewalls 24 and 26 of the end portions 20*a* and 20*b* in alignment with one another. The clip also holds the two ends 20*a* and 20*b* butted against one another to form a tight and attractive butt joint 34 in hoop 20.

Figure 3:
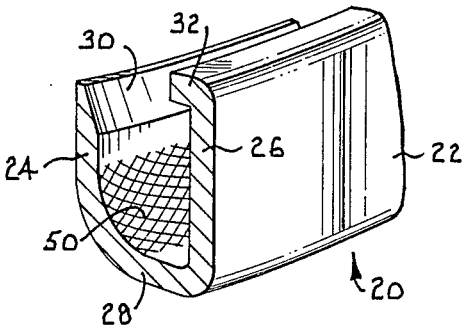
FIG. 3 is a fragmentary perspective view of one end portion of the metal hoop.

As previously indicated, the flange 18 extends into channel 22 through its open top. The flange is secured in the channel by a quantity of bonding material which preferably takes the form of polyester resin 48 reinforced by glass fibers. The resin 48 is poured into channel 22 in a liquid state until it substantially fills the channel, thus embedding the edge portion of flange 18 and securely bonding it in place within channel 22 when the resin has solidified. Clip 36 is also embedded within the resin. Capillary action draws the resin 48 against the bottom of lip 32, and it is noted that the lip thus provides an interference fit which holds the resin in place within channel 22. In order for the resin to release from the channel, it is necessary for the lip 32 or another part of the channel to be physically deformed until the lip is displaced from its interference fit with the resin. Accordingly, the lip 32 provides considerable assistance in retaining the resin 48 in place in channel 22, and this in turn enhances the security with which flange 18 is connected with the metal hoop 20. As best shown in FIG. 3, the inside surfaces of channel 22 are preferably knurled or otherwise roughened as indicated at 50 since the resin 48 adheres more raadily to the roughened surface 50 than to a smoother surface.

Figure 4:
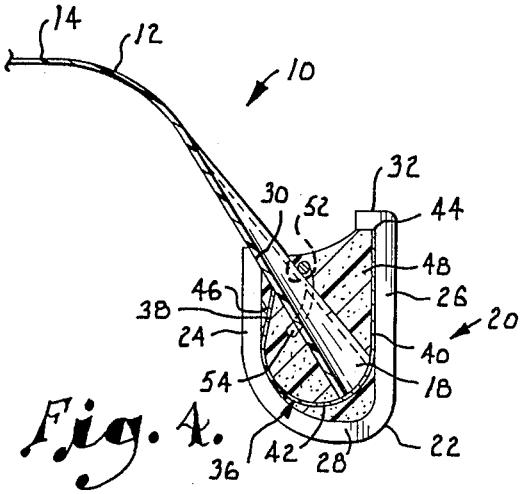
FIG. 4 is a fragmentary sectional view on an enlarged scale taken generally along line 4—4 of FIG. 1 in the direction of the arrows.

The flange 18 is preferably provided with a plurality of spaced apart openings 52 which are best shown in FIGS. 1 and 4. A fibrous cord 54 may be threaded through selected ones of the openings 52 prior to application of the resin 48. The cord 54 acts to provide additional reinforcement for the resin 48 in which it becomes embedded once the resin has hardened. The cord may be constructed of fiber glass or a synthetic plastic such as that available under the trademark KEVLAR.

Figure 5:
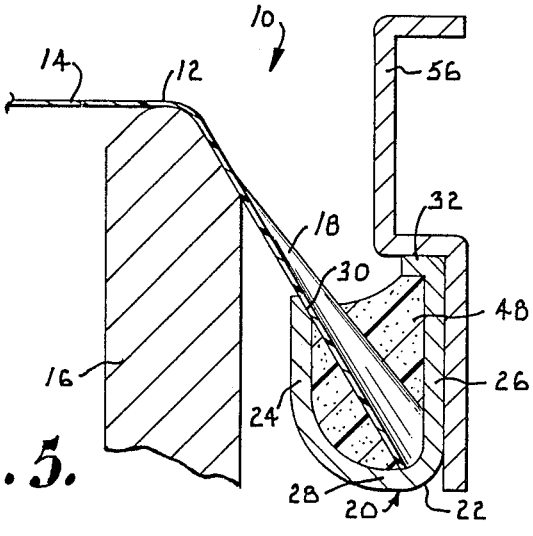
FIG. 5 is a fragmentary sectional view showing the drumhead mounted on a drum body.

After the drumhead has been constructed in the foregoing manner, it is stretched across a drum body 16 in the manner shown in FIG. 5, with the edge of the drum body receiving the area of intersection between the central portion 14 and the flange 18. A counter hoop 56 is applied to hoop 20, with part of the counter hoop engaging the outer surface of the outside wall 26 and another part of the counter hoop acting against the top surface of the lip 32. The counter hoops on the top and bottom of the drum may be adjusted by suitable tensioning mechanisms to adjust the tension of the drumhead 10. It is noted that the relatively long outer sidewall 26 provides a large surface against which the counter hoop bears. Similarly, the inturned lip 32 provides a flat shoulder surface against which the counter hoop can bear.

When forces are applied to the drumhead sheet 14, the inturned lip 32 helps to hold the polyester resin 38 in channel 22 and thus prevents the edge of flange 18 from releasing from the hoop 20 at any point along its length. The flat seating contact of flange 18 on the beveled surface 30 is to be contrasted with the conventional arrangement in which the drumhead sheet is engaged by sharp edges and other parts which can cut and otherwise unduly wear the drumhead and cause early failure. In addition, the spring clip 36 assures that the butt joint 34 will be both neat in appearance and strong enough to avoid failing as a result of the application of normal forces to the drumhead.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A drumhead construction comprising:

a plastic drumhead sheet having a generally circular edge portion;

a metal hoop presenting an open topped channel having inner and outer side walls each terminating in an upper edge, said edge portion of the drumhead sheet extending into said channel through the open top thereof;

a resinous bonding material in said channel applied to the channel in liquid form and embedding said edge portion of the drumhead sheet therein upon hardening to thereby bond the edge portion of the sheet to the hoop, said bonding material substantially filling said channel; and an inturned lip on the upper edge of said outer side wall of the channel, said lip being formed to extend inwardly from said outer side wall prior to application of the bonding material to the channel with the bonding being located beneath the lip whereby the lip holds the bonding material in the channel and must be deformed to release the bonding material from the channel.

2. The invention of claim 1, including a beveled surface on said upper edge of the inner wall of said channel, said beveled surface being substantially flat and receiving the edge portion of said drumhead sheet flatly thereon.

3. The invention of claim 1, including:

a central circular portion of said drumhead sheet;

a marginal flange extending downwardly and outwardly from said circular portion, said flange presenting said edge portion of the drumhead sheet thereon;

a beveled surface on said upper edge of the inner wall of said channel, said beveled surface being substantially flat and receiving said flange flatly thereon.

4. The invention of claim 3, including:

opposite ends of said hoop butted together to form a butt joint; and a generally U-shaped spring clip disposed in said channel and spanning said joint, said clip having opposite sides urged apart by spring action against the inner and outer side walls of said channel to hold said butted together ends against one another and in alignment, said clip being embedded in said resinous bonding material upon hardening thereof.

5. The invention of claim 4, wherein:

one side of said clip terminates in an edge lodged beneath and against said lip; and the other side of said clip includes at least one tooth having a sharp tip biting against said inner side wall of the channel.

6. The invention of claim 1, including:

opposite ends of said hoop butted together to form a butt joint; and a generally U-shaped spring clip disposed in said channel and spanning said joint, said clip having opposite sides urged apart by spring action against the inner and outer side walls of said channel to hold said butted together ends against one another and in alignment, said clip being embedded in said resinous bonding material upon hardening thereof.

7. The invention of claim 6, including an edge on one side of said clip lodged beneath and against said lip.

8. The invention of claim 7, including at least one tooth on the other side of said clip having a sharp tip biting against said inner wall of the channel.

9. The invention of claim 6, including a plurality of teeth on said clip, each tooth having a sharp tip biting against said channel.

10. A drumhead construction comprising:

a plastic drumhead sheet having a central circular portion and a marginal flange extending outwardly and downwardly from said circular portion, said flange terminating in an edge portion;

a metal hoop presenting an open topped channel having substantially straight and parallel inner and outer side walls, said flange extending into said channel through the open top thereof;

a beveled upper inside edge on the inner side wall of said channel, sai beveled upper inside edge being substantially flat and receiving said flange flatly thereon; and a resinous bonding material in said channel embedding said edge portion of the flange therein upon hardening to thereby bond said flange to the hoop.

11. The invention of claim 10, including:

opposite ends of said hoop butted together to form a butt joint; and a generally U-shaped spring clip disposed in said channel and spanning said joint, said clip having opposite sides urged apart by spring action against the inner and outer side walls of said channel to hold said butted together ends against one another and in alignment, said clip being embedded in said resinous bonding material upon hardening thereof.

12. The invention of claim 11, including at least one tooth on one side of said clip, said tooth having a sharp tip biting against one side wall of said channel.

13. The invention of claim 10, including an inturned lip on said upper edge of the outer side wall of said channel, said lip extending generally over said resinous bonding material to assist in retaining same in the channel.

14. A drumhead construction comprising:

a plastic drumhead sheet having a generally circular edge portion;

a roll formed metal hoop presenting an open topped channel having inner and outer side walls and a joint at butted together ends of the hoop, said edge portion of the drumhead sheet extending into said channel through the open top thereof;

a generally U-shaped spring clip disposed in said channel and spanning said butted together ends of the hoop, said clip having opposite sides urged apart by spring action against the inner and outer side walls of said channel to hold said butted together ends against one another and in alignment with one another; and a resinous bonding material in said channel embedding said clip and said edge portion of the drumhead sheet therein upon hardening to thereby bond the edge portion of the sheet to said hoop.

15. The invention of claim 14, including at least one tooth on one side of said clip, said tooth having a sharp tip biting against one wall of said channel.

16. The invention of claim 14, including:

an inturned lip on said outer side wall of the channel extending generally above the resinous bonding material to assist in retaining same in the channel; and an edge on one side of said clip lodged under and against said lip.

17. The invention of claim 16, including a plurality of teeth on the other side of said clip, each tooth having a sharp tip biting against the inner side wall of said channel.

18. The invention of claim 14, including a plurality of teeth on one side of said clip biting into said inner side wall of the channel.

* * * * *